United States Patent [19]

Matsui et al.

[11] Patent Number: 4,660,370

[45] Date of Patent: Apr. 28, 1987

[54] SPINNING FRAME CONTROL SYSTEM

[75] Inventors: Isamu Matsui; Shoichi Tone, both of Kyoto; Yutaka Ueda, Nara, all of Japan

[73] Assignee: Murata Kikai Kabushiki Kaisha, Osaka, Japan

[21] Appl. No.: 823,954

[22] Filed: Jan. 29, 1986

[30] Foreign Application Priority Data

Jan. 31, 1985 [JP] Japan ..... 60-17574

[51] Int. Cl.[4] ..... D01H 9/18; B65H 67/06

[52] U.S. Cl. ..... 57/281; 57/264; 57/265; 73/160; 242/35.5 A; 242/35.6 R

[58] Field of Search ..... 57/264, 265, 281, 266, 57/274, 276; 242/35.5 R, 35.5 A, 35.6 R; 73/159, 160

[56] References Cited

U.S. PATENT DOCUMENTS 3,263,499 8/1966 Gith et al. ..... 242/35.6 R X
4,463,909 8/1984 Kiriake et al. ..... 242/35.5 A
4,550,880 11/1985 Niederer ..... 242/35.5 A X

*Primary Examiner*—John Petrakes
*Attorney, Agent, or Firm*—Spensley Horn Jubas & Lubitz

[57] ABSTRACT

A spinning frame control system in which identification marks are affixed to spinning bobbins produced by a spinning frame to identify the spinning units which have produced the bobbins, respectively, while on a winder side, yarn quality data are provided on the basis of the bobbin identification marks and fed back to the spinning frame side.

20 Claims, 13 Drawing Figures

SPINNING FRAME CONTROL SYSTEM

FIELD OF THE INVENTION AND RELATED ART STATEMENT

The present invention relates to a spinning frame control system.

Yarn which has been produced by a spinning frame, especially a ring spinning frame, is conveyed and fed in the form of spinning bobbins after spinning to an automatic winder of the next step. For conveyance of spinning bobbins after spinning, a large number of bobbins are loaded into a bobbin box randomly or in good order and conveyed together in this state, or the spinning frame and the winder are connected through a bobbin conveyance path to convey bobbins one by one.

In both the above cases, bobbins after doffing from the spinning units of the spinning frame are merely fed as bobbins after spinning to the winder. Therefore, even when there occurs a phenomenon that a yarn produced by a certain spinning unit is inferior in quality to a yarn produced by another spinning unit and yarn breakage occurs frequently in a rewinding step, it is merely grasped that many yarn joined portions are present in the package obtained on the winder side. On the winder side, in which winding unit the yarn which has been produced by the foregoing specific spinning unit is to be rewound is not specified. Therefore, a bobbin after doffing from a spinning unit which produces a yarn of inferior quality for some reason or other and bobbins after doffing from other normal spinning units are fed randomly to the winder. Consequently, such yarn of inferior quality is sometimes incorporated in many of packages after doffing at the winder.

OBJECT AND SUMMARY OF THE INVENTION

It is an object of the present invention to provide a system which traces conveyance paths of yarns produced by spinning units to grasp a spinning unit which has produced a bobbin as the source of an abnormally frequent yarn breakage during rewinding at the winder, and then feeds yarn breaking information at the winder back to the spinning frame to control each spinning unit of the spinning frame.

The present invention is a spinning frame control system in which identification marks are affixed directly or indirectly to spinning bobbins produced by a spinning frame, the identification marks identifying the spinning units which have produced the said bobbins respectively, while on a winder side, yarn quality data are provided on the basis of the bobbin identification marks and fed back to the spinning frame side.

DETAILED DESCRIPTION OF PREFERRED EMBODIMENTS

Embodiments of the present invention will be described hereinunder with reference to the drawings.

Figure 3:
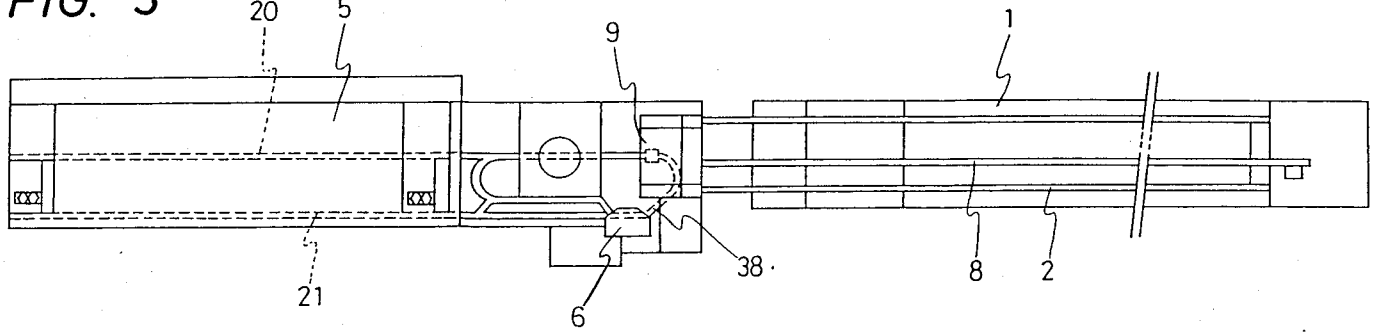
FIG. 3 is a plan view thereof.
Figure 2:
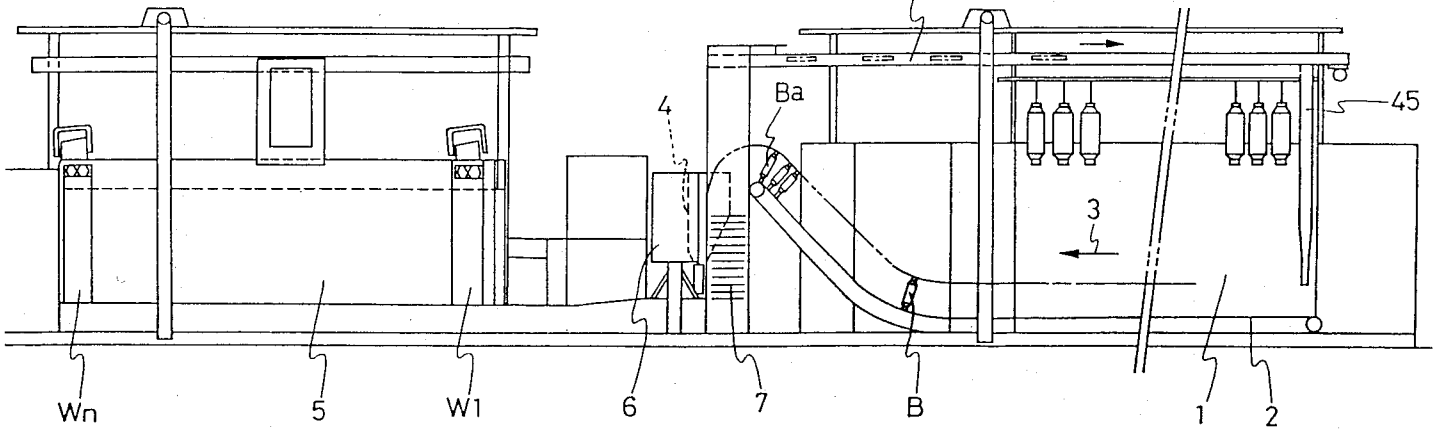
FIG. 2 is a schematic front view showing an example of a spinning winder.

A so-called spinning winder comprising a spinning frame and a winder which are directly connected together, will now be described as a first embodiment. For example, in such a spinning winder as disclosed in DE-OS No. 34 07 804 as shown in FIGS. 2 and 3, spinning bobbins B after spinning which have become full-loaded in a spinning frame 1 are doffed together and fitted upright on pegs which are erected at intervals corresponding to the pitch of the spinning units on a transport band 2 capable of moving along the spinning units. Thereafter, the transport band 2 moves intermittently in the direction of arrow 3 in accordance with a spinning bobbin request command on the winder side and bobbins are fed successively from a bobbin Ba positioned at an upper end portion of an inclined conveyor, upright through a chute 4 onto bobbin trays which stand by below.

Further, on the side of a winder 5, the bobbins are fed to winding units while being fitted upright on the bobbin trays which are bobbin conveying media independent and separate from each other, then rewound and discharged. Empty bobbins, etc. discharged from the winding units are transferred to a bobbin draw-out station 6 together with the trays. In the station 6, empty bobbins as well as bobbins with extremely slight residual yarns whose volumes are so small that their resupply to the winder and use are impossible, are drawn out from the associated trays, then the empty bobbins are returned through empty bobbin conveyance paths 7 and 8 to an empty bobbin feed position at an end portion of the spinning frame, while the bobbins with extremely slight residual yarn are separately discharged or stored into a box. Thus the trays which have passed the bobbin draw-out station 6 are only empty trays or trays which carry thereon bobbins with residual yarns whose volumes are so small that their resupply to the winder and use are impossible. Each time an empty tray reaches a spinning bobbin feed station 9, the transport band 2 on the spinning frame side advances one pitch and one spinning bobbin is fed upright onto the stand-by empty tray and thereby fed to the winding unit again.

Figure 4:
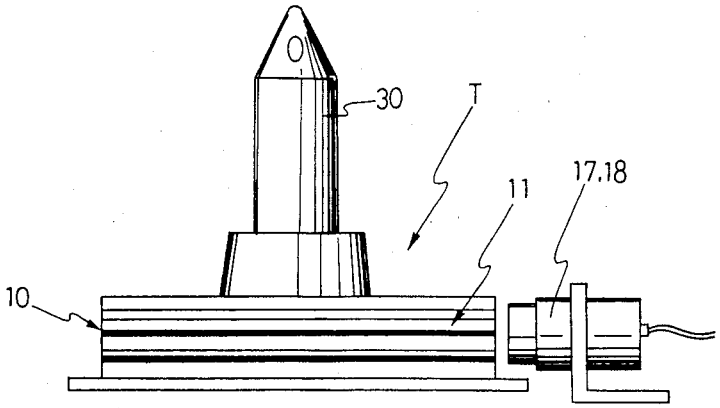
FIG. 4 is a front view showing an example of an identification mark affixed to a tray.

FIG. 4 illustrates an embodiment of bobbin tray applied to the system of the invention in such a type of a spinning winder. A tray T in FIG. 4 has a bar code 11 formed on an outer peripheral surface 10 thereof in the form of a ring, the code 11 representing a mark which specifies the said tray. A large number of trays which circulate in the winder area are all provided with different identification marks affixed thereto. For example, it is here assumed that in FIG. 3 the spinning frame 1 comprising 200 spinning units on one side, that is, 400 spinning units on both sides, and the winder 5 comprising 10 winding units W1 to Wn are directly connected and their yarn processing capabilities are well balanced, that each winding unit has a space capable of stocking three bobbins and that 50 trays are circulated within the area of the winder 5. Consequently, the marks No. 1 to No. 50 are each encoded and sticked as bar code 11 on each tray.

Figure 6:
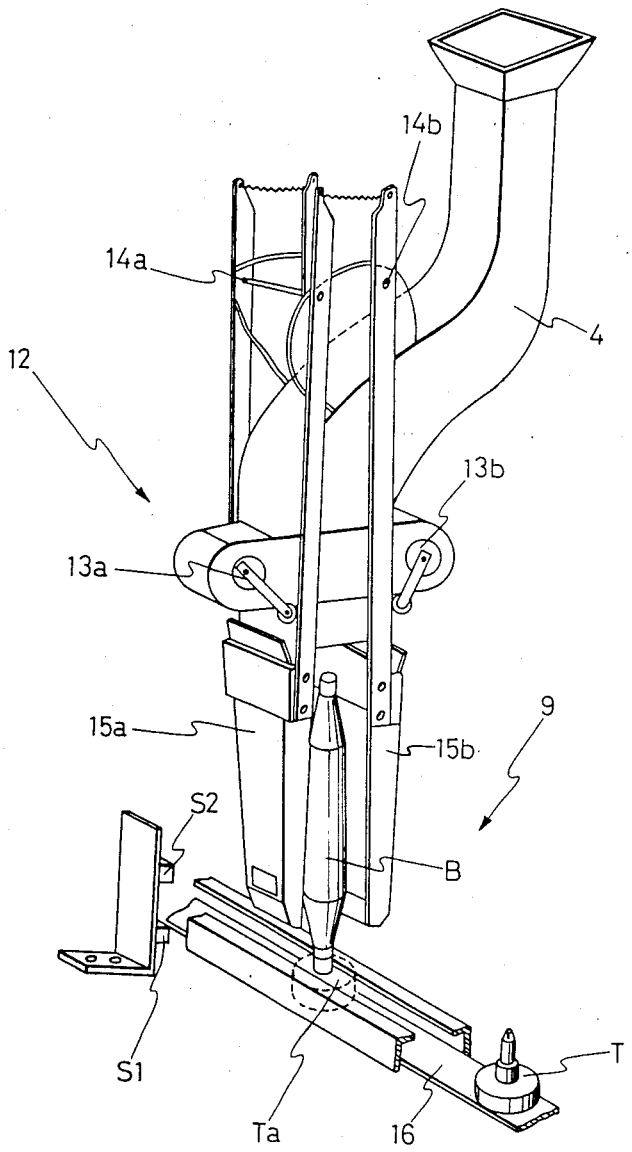
FIG. 6 is a perspective view showing an example of a bobbin feeder.

FIG. 6 shows an example of the spinning bobbin feed station 9 for the empty tray T. When the empty tray T arrives at a bobbin feed position Ta and the absence of bobbin on the tray Ta is confirmed by a tray arrival sensor S1 and a bobbin sensor S2, a bobbin request signal is provided to the spinning frame side. As a result, the transport band 2 in FIG. 3 moves one pitch and one bobbin falls into the chute 4 in FIG. 6 and is positioned upright on the tray Ta. In a bobbin feeder 12, the bobbin is guided and its movement on a conveyor 16 are controlled by opening and closing of movable guide plates 15*a* and 15*b* which are pivoted about shafts 14*a* and 14*b* by means of rotary solenoids 13*a* and 13*b*.

Further, in the bobbin draw-out station in FIGS. 2 and 3 there is provided a device having a vertically movable chucker whereby the bobbin on the tray which has arrived at this position is drawn out and carried upward and empty bobbins and bobbins with extremely slight residual yarn are sorted.

In the bobbin feed station 9 and bobbin draw-out station 6 are provided code sensors 17 and 18 for reading the bar code affixed to the tray, in a position opposed to the peripheral surface 10 of the tray as shown in FIG. 4. A tray identification signal read by the code sensor 17 is once stored in a control unit 19. At the same time, by which spinning unit the bobbin on the tray T has been produced is checked by a later-described method and the result is also stored.

Thus in this embodiment a tray and a bobbin on the tray are specified at the time of feed of the bobbin onto the tray.

Figure 7:
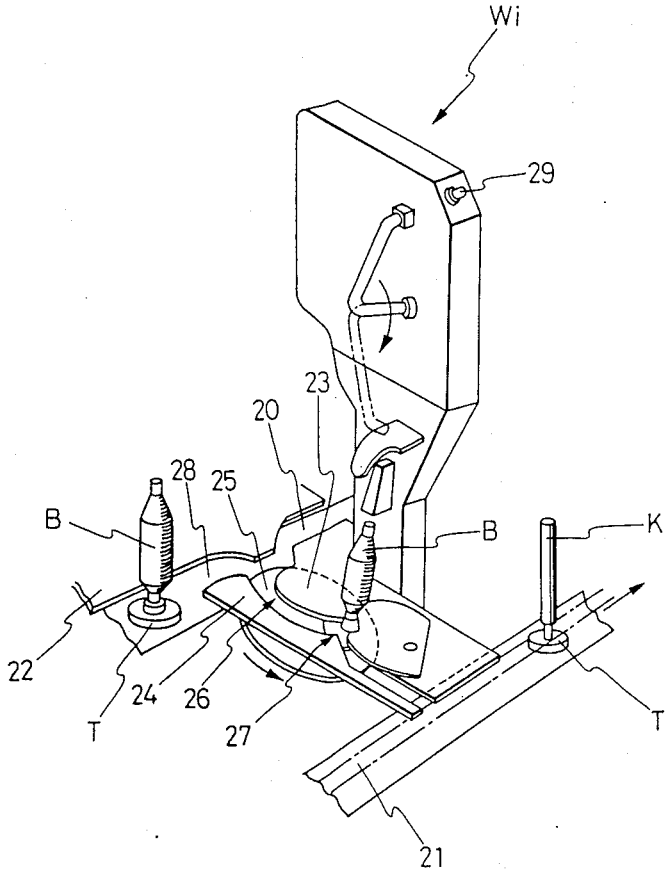
FIG. 7 is a perspective view showing an example of a winding unit.

FIG. 7 shows an example of a winding unit, in which the tray T and the bobbin B erected thereon are together taken in automatically, then subjected to rewinding, followed by discharge. More specifically, a spinning bobbin conveyance path 20 and a return path 21 for empty bobbins, etc. are formed along and on both sides of the winding unit Wi, and the advancing direction of the tray is restricted and guided by guide plates 22, 23, 24 and a rotary disc 25. In this state the bobbin is taken in automatically into a winding unit in which a stand-by slot 26 is vacant, and then reaches a rewinding position 17. When a predetermined number of bobbins have been taken in the stand-by slot 26, the succeeding bobbin is prevented from entering the slot by the tray located on the incoming side of the slot, and then moves toward the next unit from a surplus bobbin delivery port 28. Breakage of yarn at the time of rewinding from the bobbin which has reached the rewinding position is detected by a yarn breakage sensor attached to each unit and the detected signal is fed to the control unit 19. At the same time, the number of times of yarn breakage of the bobbin during winding in the winding unit is integrated and stored.

In the winding unit Wi in FIG. 7 there is provided a lamp 29 which goes on and off in accordance with a signal provided from a control section when the number of times of yarn breakage exceeds a preset value during a single bobbin winding.

The operation of the above system will be described below.

Figure 1:
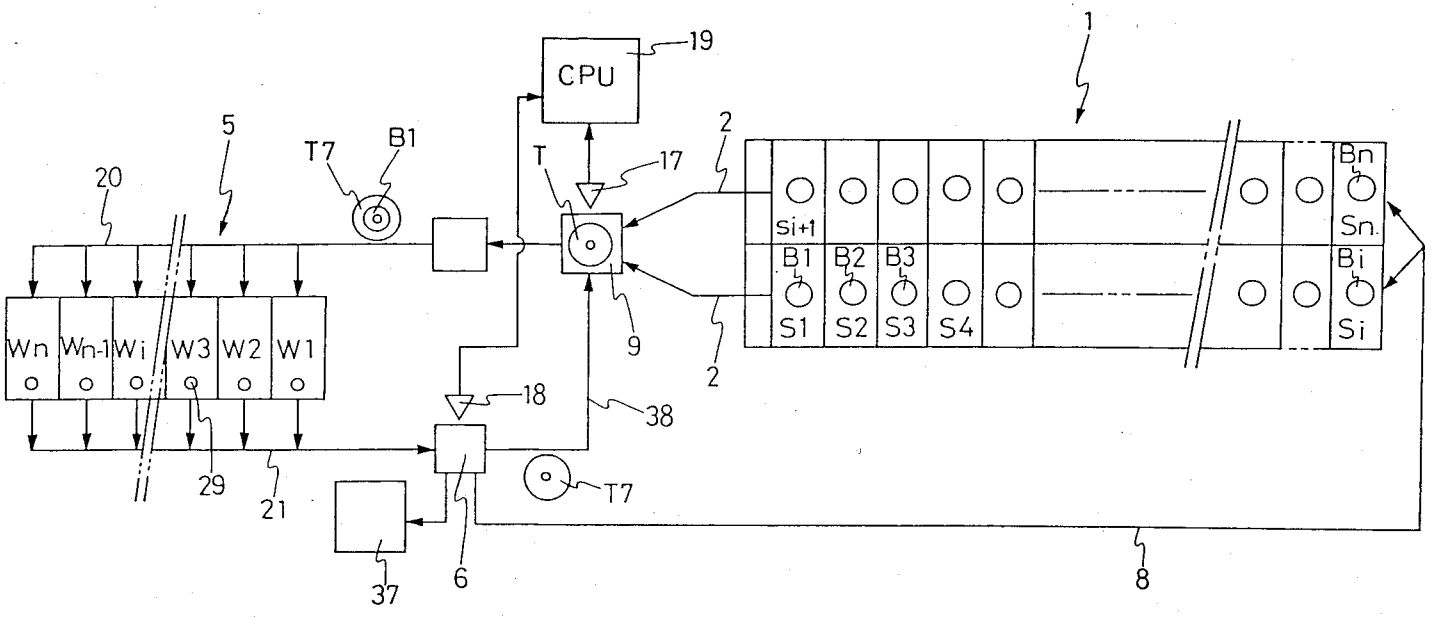
FIG. 1 is a constituent diagram of a control system according to an embodiment of the present invention.

In the spinning frame 1 shown in FIG. 1, spinning unit specifying marks are given to all the spinning units, for example, S1, S2, S3, . . . Si successively from an end portion on one side and Si+1, . . . Sn on the other side.

It is now assumed that a simultaneous doffing is completed and the spinning bobbins B1 to Bi and Bi+1 to Bn have been transferred onto the transport band located in front of the spinning units.

In this state, upon output of a bobbin request signal from the bobbin feed station 9 on the winder side, first the bobbin B1 at the leftmost end of one-side spinning units is fed onto a tray T. The tray T is conveyed randomly, so it is here assumed that the tray T which has been loaded with the bobbin B1 upright was No. T7. At this time, in a memory within the control unit is stored S1 by a counter as a mark corresponding to T7. And if the next tray is T15, a second-fed bobbin B2 is erected thereon, so S2 corresponding to T15 is stored in the memory.

It is now assumed that the tray T7 was conveyed, taken in a winding unit W3 of the winder and reached the rewinding position.

In the event the number of times of yarn breakage occurring during the rewinding operation of the above winding unit exceeds a preset range, the lamp 29 of the said unit goes on and off. This is confirmed by the operator, whereupon the bobbin on the tray T7 being discharged from this winding unit is drawn out by the operator and the tray T7 is conveyed as a bobbin-free tray on the bobbin return path 21 in FIG. 1 toward the bobbin draw-out station 6. Trays which carry upright thereon empty bobbins discharged from other winding units as well as empty trays after drawing out of bobbins by the operator because of an excessive number of times of yarn breakage, are conveyed in a randomly mixed state on the return path 21.

Such trays are conveyed in the above state and reach the bobbin draw-out station 6, in which the empty bobbins and bobbins with extremely slight residual yarn are drawn out, while the empty trays and trays having bobbins with residual yarn pass the station.

Figure 8:
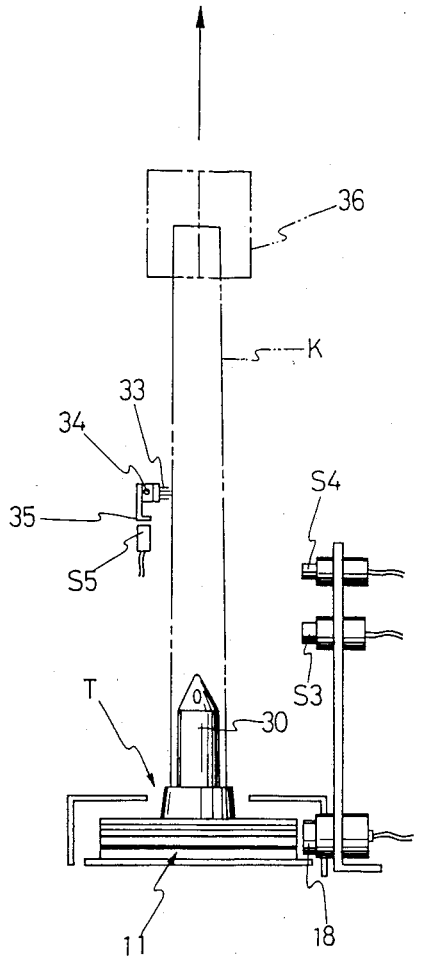
FIG. 8 is a front view showing an arrangement of various sensors in a bobbin draw-out station.
Figure 9:
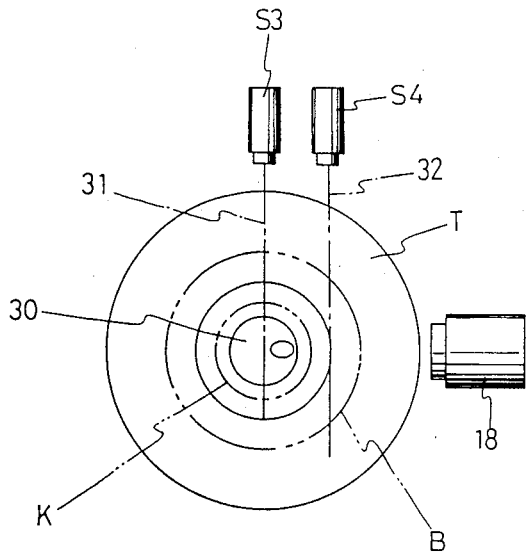
FIG. 9 is a plan view thereof.

As shown in FIGS. 8 and 9, a mark sensor 18 for detecting the arrival of tray and reading the identification mark on the tray, a sensor S3 for detecting whether a bobbin is present or not on tray, a sensor S4 for detecting a bobbin with residual yarn and a sensor S5 for detecting a bobbin with extremely slight residual yarn, are mounted in predetermined positions of the bobbin draw-out station. The mark sensor 18 is provided in a position opposed to the peripheral surface having the tray T identification mark affixed thereto. It detects whether a tray is present or not in a predetermined position by means of a combined tray stopper and projecting piece (not shown), reads the identification mark 11 and inputs the tray No. T7 to the control unit.

The empty bobbin detecting sensor S3 is positioned so that it is higher than a peg 30 of the tray and its optical axis 31 extends toward the tray center. The sensor S4 is positioned so that it is higher than the peg 30 and its optical axis 32 deviates from the outer peripheral surface of an empty bobbin K. Further, the sensor S5 comprises a proximity sensor S5 for detecting one end 35 of a brush-like feeler 33 which is in contact with the outer peripheral surface of the empty bobbin and which is rotatable about a shaft 34. When the bobbin K is drawn out upward by means of a chucker 36, if there is a residual yarn, the residual yarn will engage the feeler 33 and rotate and displace it, whereby the bobbin is judged to have an extremely slight residual yarn.

When the tray T7 arrives at the bobbin draw-out station 6 having such various sensors as mentioned above, there is no bobbin present on the tray in this position because the bobbin has already been drawn out by the operator. Therefore, a read signal from the mark sensor 18 and a bobbin absence signal from the sensor S3 are fed to the control unit 19 in FIG. 1 and it is judged that the bobbin B1 on the tray T7 which has previously been read and input in the bobbin feed station 9 is not present in the draw-out position 6. By reason that the yarn on the bobbin B1 is defective, the spinning unit S1 corresponding to the bobbin B1 is checked.

In the draw-out station 6 shown in FIG. 1, the drawn-out empty bobbin is so returned as to be fed onto a peg on the transport band at one end of the spinning frame 1, namely, the end portion opposite to the bobbin delivery side in this embodiment, through the conveyance path 8 such as a conveyor. On the other hand, bobbins with extremely slight residual yarn are stored into a bobbin box 37 which is provided near the draw-out station 6. Therefore, empty trays and trays having bobbins with residual yarn are conveyed in a mixed state on a passage 38 formed between the draw-out station 6 and the bobbin feed station 9.

Thus, from the fact that the tray which has arrived at the bobbin draw-out station 6 is empty, it is possible to detect the spinning unit which has produced the bobbin present previously on this tray. When the same spinning unit has been detected more than a preset number of times, it is judged that this spinning unit involves some defectiveness, and on the basis of this judgment the unit in question is checked.

Figure 10:
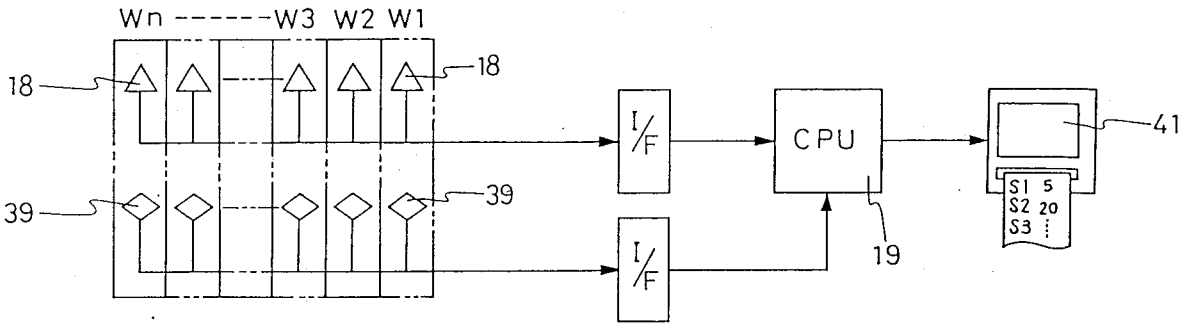
FIG. 10 is a block diagram of a control system according to another embodiment of the present invention.

In FIG. 10, the mark sensor 18 which has been provided in the bobbin draw-out station is attached to each of the winding units W1 to Wn, and the identification mark of the tray having a bobbin erected thereon under rewinding operation is read and input to the control unit 19. On the other hand, a signal from a yarn breakage detector 39 in each winding unit is fed to the control unit, and when the number of times of yarn breakage during winding operation for each bobbin exceeds a preset value, the bobbin on the tray concerned is identified by the identification mark on that tray and an associated spinning unit is detected in the same way as above. Thus, in this case the detection of a winding unit can be done during winding operation, so it is not necessary for the operator to draw out the bobbin on the tray discharged from a winding unit, nor is it necessary to provide a mark sensor in the bobbin draw-out station 6.

Figure 5:
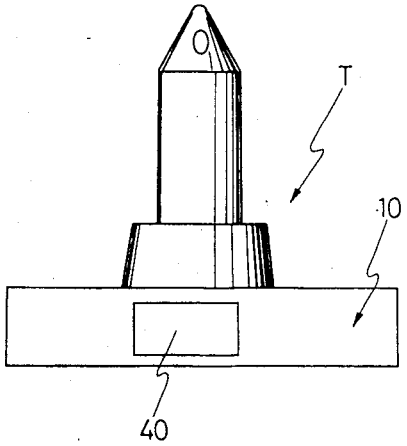
FIG. 5 is a front view showing another example thereof.

In the above embodiment a bar code is used as a tray identification mark, while FIG. 5 illustrates an embodiment in which a magnetic tape 40 capable of being written and erased is sticked on the outer peripheral surface 10 of the tray T. In the case of using such a tray T, an identification signal indicating by which spinning unit the bobbin fed to each tray has been produced, may be written in the magnetic tape. Therefore, a writing device is provided in this position, while in the bobbin draw-out station 6 there is provided a device for reading the above written signal. During winding operation in each winding unit, a bobbin on which yarn has broken many times is drawn out by the operator in the same way as above after its discharge from the winding unit and the tray is conveyed as an empty tray to the bobbin draw-out station 6, in which the spinning unit mark written in the magnetic tape 40 on the empty tray may be read.

According to such bobbin control, as soon as an abnormally frequent breakage of yarn produced by a specific spinning unit is confirmed by a display unit 41 shown in FIG. 10, there can be performed inspection and repair of the spinning frame immediately. It is also possible to display an abnormal spinning unit by, for example, turning on and off a red lamp in such abnormal unit in accordance with a signal provided from the control unit 19.

In the above embodiment there has been described a spinning winder comprising a spinning frame and a winder which are directly connected together. The following description is now provided about a spinning frame control system in the case where bobbins which have gone through a spinning frame are housed randomly in a box and conveyed to the winder side.

Figure 12:
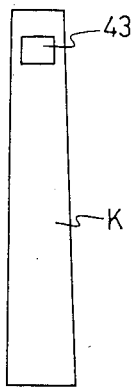
FIGS. 11 and 12 are front views showing examples of identification marks affixed directly to bobbins.
Figure 11:
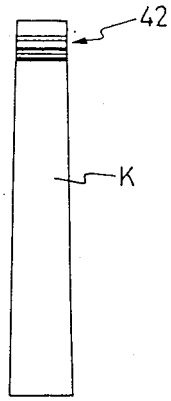

As shown in FIGS. 11 and 12, bobbin identifying marks are affixed to empty bobbins K themselves. In FIG. 11, No. 1 to No. n are indicated on bobbins using bar codes, while in FIG. 12 there is used a magnetic tape 43.

Figure 13:
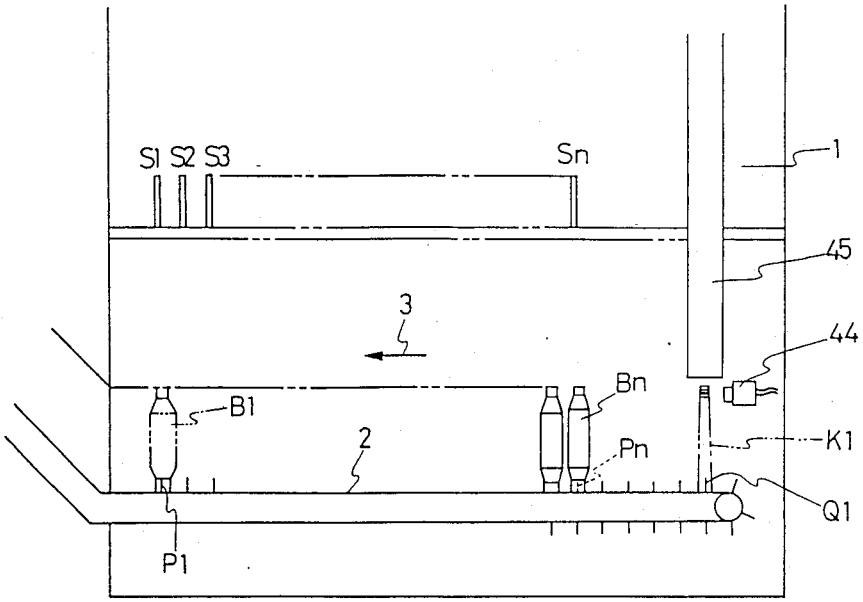
FIG. 13 is a schematic view showing a bobbin reading position on a spinning frame side in the case of using the bobbin shown in FIG. 11.

In this case, as shown in FIG. 13, every time an empty bobbin K is fed to a peg on a transport band 2 in a spinning frame 1, an identification mark of the bobbin is read and stored by a reader 44. More specifically, after a simultaneous doffing is performed and full-loaded bobbins B1 to Bn are fitted on pegs P1 to Pn corresponding to spinning spindles S1 to Sn, the transport band 2 is moved intermittently in the direction of arrow 3 and empty bobbins K are fed successively from an empty peg Q1 by means of an empty bobbin feeder 45. For example, upon delivery of the rearmost spinning bobbin Bn, the head empty bobbin K1 reaches a position corresponding to the spindle S1 and the identification mark of the empty bobbin K1 first fed to the empty peg Q1 is read. If this bobbin is No. 50 bobbin, the bobbin No. 50 is fed and stored, as a bobbin correlated with the spinning unit S1, into the memory of the control unit. Then, the feed of an empty bobbin is counted each time the transport band 2 moves intermittently pitch by pitch and at the same time the spinning units S2 to Sn are made correspondence to succeeding empty bobbins successively and thus specific bobbins are correlated with specific spinning units.

Spun yarn is wound round the thus-fed empty bobbins and when each such bobbin becomes fully loaded, it is delivered from the spinning frame by the operation described above. The bobbins thus delivered are housed randomly in a bobbin box and fed for rewinding to winding units on the winder side. During rewinding, as previously noted, when the number of times of yarn breakage is counted by the yarn breakage detector attached to each winding unit and exceeds a preset value, the lamp provided in each winding unit goes on and off, thereby indicating a rewinding of a defective yarn to let the operator know this situation. The identification mark of the bobbin discharged from this winding unit is read by a reading device which is provided separately, and if this bobbin is the foregoing bobbin No. 50, for example, the spinning unit S1 correlated with the said bobbin can be confirmed.

By so doing, bobbins can be specified directly by their identification marks and consequently their associated spinning units can be discriminated. Further, if numerals 1, 2, 3, . . . n capable of being visually read by the operator are used as such identification marks and a reader capable of reading those numerals is provided in the empty bobbin feed position (44 in FIG. 13), then it is possible for the operator to directly read bobbins discharged from the winder, and by inputting of the thus-read numerals it is made possible to specify the bobbin numbers stored in the control unit and spinning units.

Although the number of times of yarn breakage in the winder has been used as yarn quality information in the above embodiments, there may be used other yarn quality data for specifying spinning units such as, for example, the number of slubs and the proportion of fine yarn portion and that of thick yarn portion.

According to the present invention, as set forth hereinabove, by tracing a spinning bobbin produced in a spinning frame and on the basis of yarn quality information obtained during rewinding operation, it is possible to specify which spinning unit has produced the yarn concerned, thus permitting a machine control for each spinning unit, which is extremely effective in producing a yarn of good quality.

What is claimed is:

1. A system controlling a spinng frame comprising:

a plurality of spinning units;

a winder including a plurality of winding units and a bobbin conveyance path;

means for transporting spinning bobbins on the bobbin conveyance path, said means for transporting spinning bobbins having an identification mark affixed thereto;

a spinning bobbin feed station which is disposed along the bobbin conveyance path and is provided with a first sensor for reading the identification mark;

a bobbin draw-out station which is disposed along the bobbin conveyance path and is provided with a second sensor for reading the identification mark; and a processing device for storing the identification signal read by said first and second sensors.

2. The system as clained in claim 1, wherein said spinning units are arranged along a transport band, said winding units are connected with each other by the bobbin conveyance path through the spinning bobbin feed station and the bobbin draw-out station, and the transport band and the bobbin conveyance path are connected with each other through the spinning bobbin feed station.

3. The system as claimed in claim 1, wherein said means for transporting a bobbin is a tray on which a spinning bobbin is fed from the spinning bobbin feed station and erected upiright and the identification amrk is affixed to an outer peripheral surface thereof.

4. The system as claimed in claim 3, wherein said identification mark is a bar code.

5. The system as claimed in claim 3, wherein said identification mark is a magnetic tape capable of being written and erased.

6. The system as clained in claim 1, wherein said spinning bobbin feed station further includes a tray arrival sensor and a bobbin sensor for detecting the presence or absence of a bobbin on the tray and having a means for emitting a spinning bobbin request signal to the spinning frame side and receiving a spinning bobbin from the spinning frame upon detection of the absence of a bobbin on the tray.

7. The system as claimed in claim 1, wherein said bobbin draw-out station further includes a device having a vertically movable chucker whereby the bobbin on the tray is drawn out, and a device for discriminating and distributing an empty bobbin and a bobbin with extrememly slight residual yarn.

8. The system as claimed in claim 1, wherein a mark sensor is provided in each of the winding units and the identification mark of the tray having a bobbin erected thereon under rewinding operation is read by the mark sensor and input to the processing device.

9. The system as claimed claim 8, wherein a yarn breakage sensor is further provided in each winding unit for detecting yarn breakage at the time of rewinding a yarn from a bobbin and the detected signal is fed to the processing device where the number of times of yarn breakage of the bobbin during winding in the winding unit is integrated and stored.

10. The system as claimed in claim 9, wherein the winding unit further includes a lamp which goes on and off in accordance with a signal provided from the processing device when the number of times of yarn breakage exceeds a preset value during a single bobbin winding.

11. A system for controlling a spinning frame comprising:

a plurality of spinning units;

a winder including a plurality of winding units and a bobbin conveyance path;

means for transporting spinning bobbins on the bobbin conveyance path, said bobbins having an identification mark affixed thereto;

a spinning bobbin feed station which is disposed along the bobbin conveyance path and is provided with a first sensor for reading the identification mark;

a bobbin draw-out station which is disposed along the bobbin conveyance path and is provided with a second sensor for reading the identification mark; and, a processing device for storing the identification signal read by said first and second sensors.

12. The system as claimed in claim 11, wherein said spinning units are arranged along a transport band, said winding units are connected with each other by the bobbin conveyance path through the spinning bobbin feed station and the bobbin draw-out station, and the transport band and the bobbin conveyance path are connected with each oter through the spinning bobbin feed station.

13. The system as claimed in claim 11, wherein said means for transporting a bobbin is a tray on which a spinning bobbin is fed from the spinning bobbin feed station and erected upright.

14. The system as claimed in claim 13, wherein said identification mark is a bar code.

15. The system as claimed in claim 13, wherein said identification mark is a magnetic tape capable of being written and erased.

16. The system as claimed in claim 11, wherein said spinning bobin feed station further includes a tray arrival sensor and a bobbin sensor for detecting the presence or absence of a bobbin on the tray and having a means for emitting a spinning bobbin request signal to the spinning frame side and receiving a spinning bobbin from the spinning frame upon detection of the absence of a bobbin on the tray.

17. The system as claimed in claim 11, wherein said bobbin draw-out station further includes a device having a vertically movable chucker whereby the bonnin on the tray is drawn out, and a device for discriminating and distributing an empty bobbin and a bobbin with extremely slight residual yarn.

18. The system as claimed in claim 11, wherein a mark sensor is provided in each of the winding units and the identification mark of the tray having a bobbin erected thereon under rewinding operation is read by the mark sensor and input to the prcessing device.

19. The system as claimed in claim 18, wherein a yarn breakage sensor is further provided in each winding unit for detecting a yarn breakage at the time of rewinding a yarn from a bobbin and the detected signal is fed to the processing device where the number of times of yarn breakage of the bobbin during winding in the winding unit is integrated and stored.

20. The system as claimed in claim 19, wherein the winding unit further includes a lamp which goes on and off in accordance with a signal provided from the processing unit when the number of times of yarn breakage exceeds a preset value during a single bobbin winding.

* * * * *